US005426702A

United States Patent [19]

Aarts

[11] Patent Number: 5,426,702

[45] Date of Patent: Jun. 20, 1995

[54] SYSTEM FOR DERIVING A CENTER CHANNEL SIGNAL FROM AN ADAPTED WEIGHTED COMBINATION OF THE LEFT AND RIGHT CHANNELS IN A STEREOPHONIC AUDIO SIGNAL

[75] Inventor: Ronaldus M. Aarts, Eindhoven, Netherlands

[73] Assignee: U.S. Philips Corporation, New York, N.Y.

[21] Appl. No.: 136,798

[22] Filed: Oct. 14, 1993

[30] Foreign Application Priority Data

Oct. 15, 1992 [EP] European Pat. Off. ..... 92203155.4

[51] Int. Cl.[6] ..... H04R 5/00

[52] U.S. Cl. ..... 381/27; 381/22

[58] Field of Search ..... 381/27, 18, 22

[56] References Cited

U.S. PATENT DOCUMENTS

| | | | |
|---|---|---|---|
| 4,024,344 | 5/1977 | Dolby et al. | 179/1 G |
| 4,293,821 | 10/1981 | Boudouris et al. | 330/126 |
| 4,532,647 | 7/1985 | Willcocks | 381/22 |
| 4,696,036 | 9/1987 | Julstrom | 381/22 |
| 5,297,209 | 3/1994 | Kowaki | 381/27 |

*Primary Examiner*—Stephen Brinich

*Attorney, Agent, or Firm*—Edward W. Goodman

[57] ABSTRACT

The system includes a direction detection circuit (32) for deriving a measure (Vwh) for a direction of a direction vector (Wh) which vector, in a state area in which combinations (R,L) of signal values of the left and right channel signals are shown at specific instants, is indicative of the direction of the most powerful sound source. A circuit (33) derives from this measure (Vwh) two weight factors (w1,w2). A center channel signal (C) is derived which is a weighted sum of the left (L) and right (R) channel signal determined by the weight factors (w1,w2). In this manner a center channel signal is obtained which has a less dull sound on reproduction.

12 Claims, 4 Drawing Sheets

SYSTEM FOR DERIVING A CENTER CHANNEL SIGNAL FROM AN ADAPTED WEIGHTED COMBINATION OF THE LEFT AND RIGHT CHANNELS IN A STEREOPHONIC AUDIO SIGNAL

BACKGROUND OF THE INVENTION

1. Field of the Invention

The invention relates to a deriving system for deriving a center channel signal from a stereophonic signal comprising a left and a right channel signal. The use of a center channel signal in stereophonic sound reproduction has the effect that the position of the perceived virtual sound sources is less dependent on the position taken up by the listener relative to the left and right loudspeakers. This is especially important in the case where the reproduction of stereophonic audio information is combined with image reproduction, as is the case, for example, with TV comprising stereophonic sound reproduction. For, when a reproduced audio visual program is followed, it is important that the position of the perceived virtual sound sources is not perceived to be far from the position of the picture screen.

2. Description of the Related Art

A system for deriving a center channel signal is known from U.S. Pat. No. 4,024,344.

In the system described in that Patent, there is detected whether the low-frequency portions of the left and the right channel signal include correlated signal components. When this is detected, the low-frequency signal components in the left channel signal are multiplied by the low-frequency components in the right channel signal. The DC components of the result of the multiplication is compared with the sum of the DC components of the rectified channel signals.

Depending on the result of the comparison, a larger or smaller part of the sum of low-frequency components of the left and the right channel signal is used as a center channel signal.

The disadvantage of prior-art system is that in the center channel signal, the left and right channel signals are both represented equally strongly. This means that opposite-phase signal components in the left and right channel signals disappear in the thus obtained center channel signal. This is especially detrimental in the case where the opposite-phase components come from the most powerful sound source in the stereophonic signal. The disappearance of the opposite-phase components when the left and right channel signals are added up with an equal weight factor is one of the reasons why the listener experiences the thus obtained center channel signal as sounding dull.

SUMMARY OF THE INVENTION

It is an object of the invention to provide a system by which a center channel signal is obtained outweighting said disadvantages.

According to the invention, this is achieved by a system as defined in the opening paragraph, which is characterized in that the system comprises means for deriving a measure for a direction of a direction vector which, in a state area in which combinations of signal values of the left and right channel signals are shown at specific instants, is indicative of the direction determined in the state area by the signal values originating from the most powerful sound source, determining means for determining a weighted sum of the left and right channel signals, said sum being determined by weight factors, and setting means for setting the weight factors in response to the derived measure, and in which the determined weighted sum forms the center channel signal.

In the system according to the invention, the extent to which the left and right channel signals contribute to the center channel signal depends on the direction of the most powerful sound source. The detected direction depends on the mutual phase difference between the left and correct channel signals. A right choice of the weight factors may also provide that dominant components in the derived center channel signal disappear less as a result of opposite phases.

The direction of the most powerful sound source may be measured in numerous ways, for example, based on estimation techniques with which the dominant direction in the state area is determined in response to the combinations of signal values. A possible estimation techniques is the so-termined least-squares method with which the direction of a curve through the origin of the state area is selected in such a way that the sum of the squares of the distances from the curve to the state area points, which points are formed by the combinations, is minimized. However, also other methods are suitable.

A measurement which is attractive because it can be realized in a relatively simple manner, is realized in an embodiment for the system, characterized in that the system comprises means for producing a first and a second vector component signal which represent components of said direction vector, the weight factors being dependent on the components of the direction vector, deriving means for deriving a first and a second adaptation value for the vector component signals from the combination of signal values and the inproduct of the direction vector and the vector determined by the combination of signal values, the ratio between the first and second adaptation values corresponding to the ratio between the signal values of the left and right channel signals of the signal value combination, and the signs of the first and second adaptation values being determined by the sign of the inproduct and the signs of the signal values of the left and right signal channels from the signal value combination, adaptation means for adapting the signal values of vector component signals by adding the first adaptation values to the first vector component signal and by adding the second adaptation values to the second vector component signal.

By making the adaptation of the direction vector depend on the sign of the inproduct, there is achieved that the direction of the adaptation is always in conformity with the direction vector. Without this dependence, the direction vector would not change on average, because both the left and the right channel signal are signals not containing DC components.

A further embodiment for the system is characterized in that the setting means are arranged for setting the weight factors whose signs depend on the direction of the direction vector.

The virtual sound sources in the stereophonic image generally differ both in place and in frequency. Therefore, it is advantageous to split up the correlated signal components for different frequency bands. In this manner there is achieved that the splitting up of the correlated components for different sound sources is carried out in a mutually independent manner.

BRIEF DESCRIPTION OF THE DRAWINGS

The invention will be further explained with reference to the drawing FIGS. 1 to 9, in which.

DESCRIPTION OF THE PREFERRED EMBODIMENT

Figure 1:
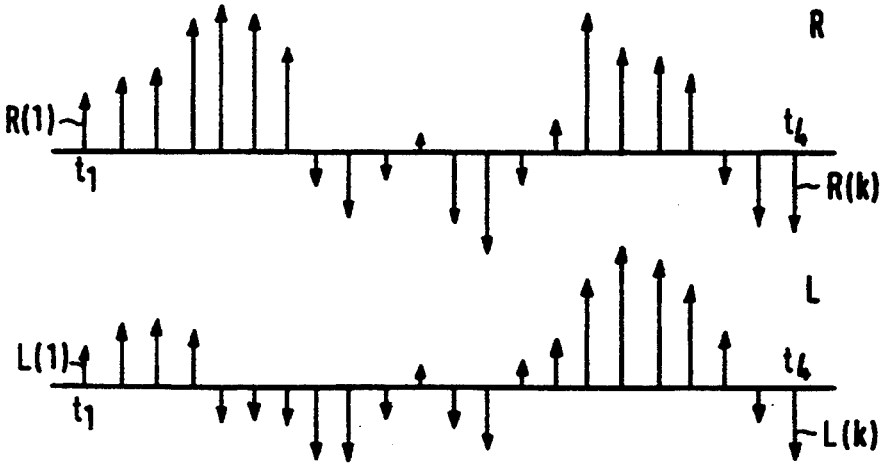
FIG. 1 shows an example of a discrete-time stereophonic audio signal.
Figure 2:
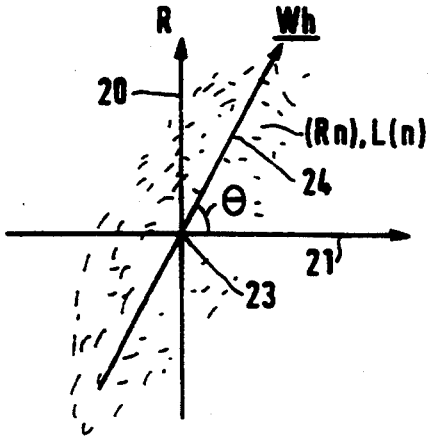
FIG. 2 shows a two-dimensional state area in which combinations of associated signal values of the left and right channel signals are shown.

FIG. 1 shows an example of a discrete-time stereophonic signal which includes a right channel signal R and a left channel signal L. The right channel signal R comprises a series of samples R(1), . . . , R(k) denoting the signal values of the right channel signal at equidistant instants t1, . . . , tk. The left channel signal comprises a series of samples L(1), . . . , L(k) denoting the signal values of the left channel signal at equidistant instants t1, . . . , tk. FIG. 2 shows a state area in which points indicate the positions of the combinations (R(n),L(n)) of the signal values of the left and right channel signals at the instants tn. The diagram shows two axes referenced 20 and 21 which intersect at an origin 23. The vertical position of each point denotes the signal value of the right channel signal R, whereas the horizontal position of each point denotes the signal value of the left channel signal L at the same instant. Reference character 24 denotes a direction vector Wh. This direction vector shows the average direction of the vectors formed by the origin 23 and each of the positions of the combinations (R(n),L(n)). This direction vector Wh may be considered the vector denoting the direction of the most powerful sound source in the stereophonic signal. The inventive idea underlying the invention is that the direction of the direction vector may be used for determining the measure to which the left and right channel signals contribute to the center channel signal. A suitable choice of the weight factors is the one in which a first weight factor w1, denoting the contribution of the left channel signal L to the center channel signal C, is equal to sin ($\theta$), where $\theta$ is the angle between the axis 21 and the direction vector Wh, and in which a second weight factor w2, denoting the contribution of the right channel signal R to the center channel signal C, is equal to cos ($\theta$).

If such a choice is made, dominant signal components occurring in the opposite-phase left and right channel signals are maintained in the center channel signal, as will be illustrated hereinafter with an example.

Let us assume that the left channel signal L is equal to A. sin (fl.t) and the right channel signal R is equal to −A. sin (f1.t), where t denotes time and f1 represents a frequency. The corresponding direction vector is referenced 40 in FIG. 4. The weight factors w1 and w2 are then $-2^{-\frac{1}{2}}$ and $2^{-\frac{1}{2}}$, respectively. The center channel signal is then $2^{\frac{1}{2}}$.A. sin (f1.t).

Figure 4:
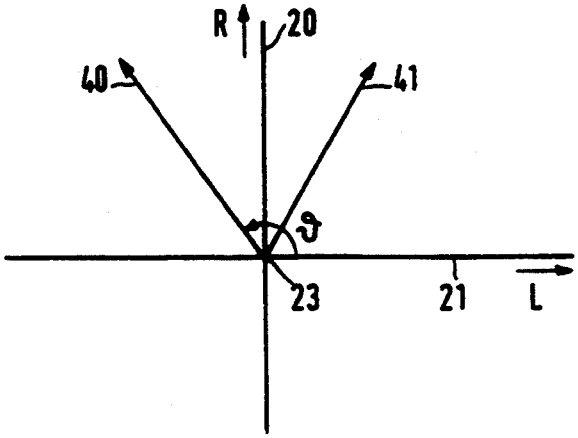
FIGS. 4, 5 and 6 show state areas including direction vectors in explanation of the invention.

In the case where the left channel signal and the right channel signal are in phase, for example L=R=A. sin (f1.t), the corresponding direction vector has a direction as shown in FIG. 4 by reference character 41. In that case the values for the weight factors are both equal to $2^{-\frac{1}{2}}$. The center channel signal is then equal to $2^{\frac{1}{2}}$.A. sin (fl.t). As appears from the foregoing, there is always a center channel signal available irrespective of the phase of the left and right channel signals.

There should be observed, however, that different choices of weight factors from the choice described before are also possible. For example, it is possible to make only the sign of the weight factors and not the absolute value of the weight factors depend on the direction of the direction vector. In principle, any relation between the direction vector and the weight factors, for which relation there is reduced opposition to the center channel signal components that originate from the left and right channel signals, is suitable.

Figure 3:
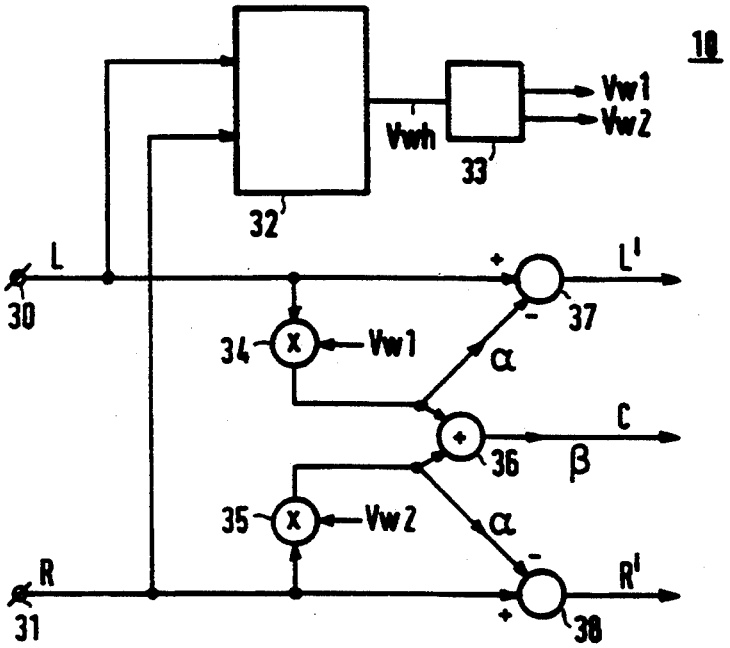
FIGS. 3 and 9 show embodiments for systems according to the invention.

FIG. 3 shows an embodiment for a system 10 in which this realized. The system shown has two inputs 30 and 31 for receiving a or the respectively, left channel signal (L) and right channel signal (R) of a stereophonic signal. A direction detection circuit 32 is coupled by its inputs to the inputs 30 and 31 for receiving the left channel signal (L) and right channel signal (R). A signal Vwh, which is indicative of the direction of the vector Wh, is applied to a circuit 33 which derives therefrom two signals Vw1 and Vw2 which represent two weight factors w1 and w2. The signal Vw1 is applied to a first input of a multiplier 34, whereas the signal Vw2 is applied to a first input of a multiplier 35. A second input of the multiplier 34 is coupled to the input 30 for receiving the left channel signal L. An output of the multiplier 34 presents a signal that is equal to the left channel signal L multiplied by the signal Vw1 representing the weight factor W1. A second input of the multiplier 35 is coupled to the input 31 for receiving the right channel signal R. An output of the multiplier 35 presents a signal that is equal to the right channel signal R multiplied by the signal Vw2 representing the weight factor w2. The output signals of the multipliers 34 and 35 are combined to the center channel signal C by the adder circuit 36, which signal is equal to $\beta$ times the sun of the output signals of the multipliers 34 and 35. To provide that the total signal contents are not appreciably affected by the addition of a center channel signal, the signals on the outputs of the multipliers 34 and 35 are subtracted from the left channel signal L and the right channel signal R, respectively, by subtracters 37 and 38. The output of subtracter 37 presents an adapted left channel signal L′ which comprises the original left channel signal L diminished by a portion ($\alpha$) of the original left channel signal L used for generating the center channel signal C. The output of the subtracter circuit 38 presents an adapted right channel signal R′ which comprises the original right channel signal R diminished by a portion ($\alpha$) of the original right channel signal R used for generating the center channel signal C.

In the system represented in FIG. 3, an adapted left channel signal L′, an adapted right channel signal R′ and a center channel signal C are derived. There should be observed that the invention is not restricted to the derivation of a center channel signal in combination with the left and right channel signals. Alternatively, it is possible to derive a center channel signal only. In that case, a monophonic signal is obtained which sounds less dull than the monophonic signal obtained from the addition of the left and right channel signals. Furthermore, it is noted that the signals L′, C and R′ can be set by setting the values $\alpha$ and $\beta$. One option is $\alpha=\beta=1'$ for which holds that $L+R=L'+R'+C'$.

Alternatively, it is possible to select $\alpha$ and $\beta$ such that the ingoing power $Pin=L^2+R^2$ is equal to the outgoing power $Pout=(L')^2+(R')^2+C^2$. It will be obvious that a great many other criteria are possible for selecting the values of $\alpha$ and $\beta$.

Figure 5:
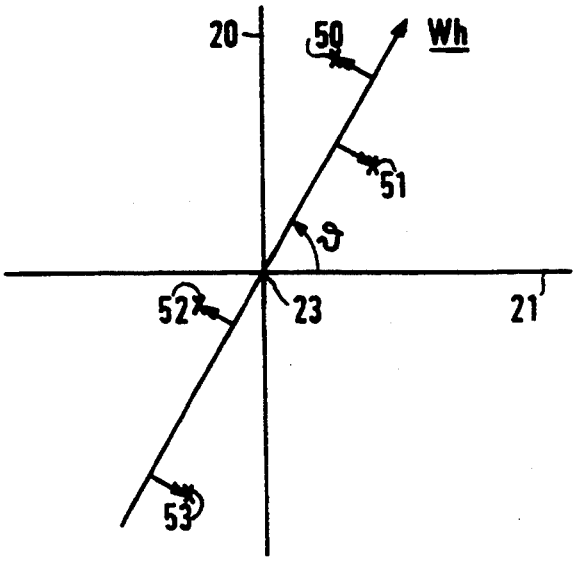

The direction of the direction vector Wh may be determined in a number of ways. The principle of a first possibility will be explained hereinafter with reference to FIG. 5. In this drawing Figure, the number of combinations (R(n),L(n)) of the signal values of the left and right channel signals is kept small for clarity. The points denoting these combinations are referenced 50, 51, 52 and 53. The vector Wh may be found by determining the very line intersecting the origin 23 for which the squared sum of the distances from the points 50, . . . , 53 to the vector Wh is minimized. Various algorithms are known for this calculation. Therefore, these algorithms will not be described in further detail.

Figure 6:
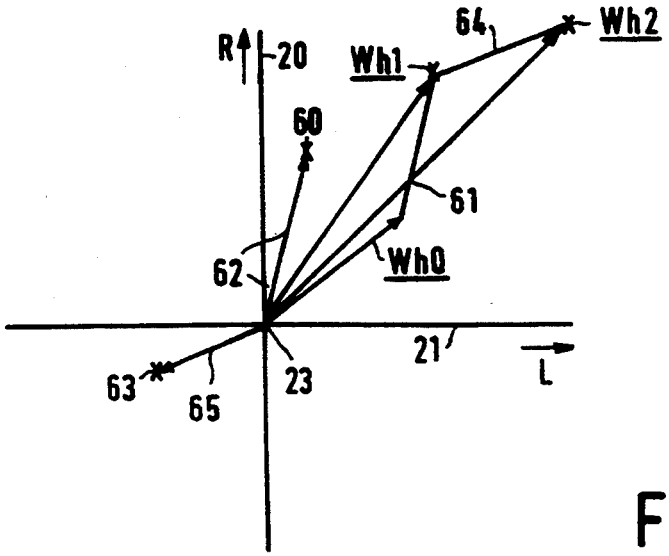

Another way of determining the direction of the vector Wh which is highly attractive because it is simple to realize, will be explained hereinafter with reference to FIG. 6.

Let us assume that at instant t1, the direction vector is Wh0. The combination (R(1),L(1)) of the signal values of the right and left channel signals is denoted by point 60. Depending on the sign of the inproduct of the direction vector Wh0 and a vector 62 determined by the origin 23 and point 60, the direction vector Wh0 is adapted with an adaption vector Va1 which has a direction that corresponds to the direction of the vector 62 determined by point 60, or an adaptation vector which has a direction opposite to the vector laid down by point 60. (The inproduct I of two vectors (x1,x2) and (x3,x4) is defined here as $I=x1.x3+x2.x4$). The inproduct of the vector determined by point 60 and the direction vector Wh0 is positive, so that the direction vector Wh0 is adapted with an adaptation vector 61 which has a direction that corresponds to the vector 62 determined by point 60. The length of the adaptation vector 61 preferably corresponds to the length of the vector 62. However, this is not necessary. It is alternatively possible to assign to the adaptation vector a different length from that of the vector 62. For example, it is possible to assign a predetermined unit of length to the adaptation vector. It is only essential that the direction of the adaptation vector be determined by the sign of said inproduct. The direction vector adapted by the adaptation vector 61 is referenced Wh1. The moment a next combination (R,L) of signal values is available, the direction vector is re-adapted. Let us assume that the next combination (R,L) becoming available at instant t2 is determined by point 63. The vector determined by point 62 is referenced 65. The inproduct of the vector 65 and the direction vector Wh1 is negative. This is to say, that the adaptation vector referenced 64 has a direction opposite to that of the vector 65. The adapted direction vector, obtained after adaptation with the adaptation vector 64, is referenced Wh2. For each next combination (R,L) that becomes available, the direction vector is adapted in the manner described hereinbefore. The direction vector will also adopt a direction that corresponds to the average direction of the adaptation vectors determined by the successive combinations (R,L) and associated improducts. Since the adaptation vector during the adaptation of the direction vector described hereinbefore has always a component parallel with the direction vector Wh, the length of the direction vector will increase after each adaptation. In addition, the contents of the stereophonic signal and thus the direction of the most powerful sound source change continuously. Therefore, the adaptation is preferably carried out in that only a limited number of combinations (R,L) from the recent past determine the direction vector. This may be effected by always determining the direction vector on the basis of a limited number of combinations (R,L) which are situated in a time window immediately preceding the instant at which the direction vector is determined. It has appeared that for determining the direction vector, a time window of a length of the order of several tens of milliseconds is sufficient. Alternatively, it is possible to determine the direction vector in such a way that the degree of influence of a combination (R,L) diminishes as this combination is situated further in the past.

Figure 7:
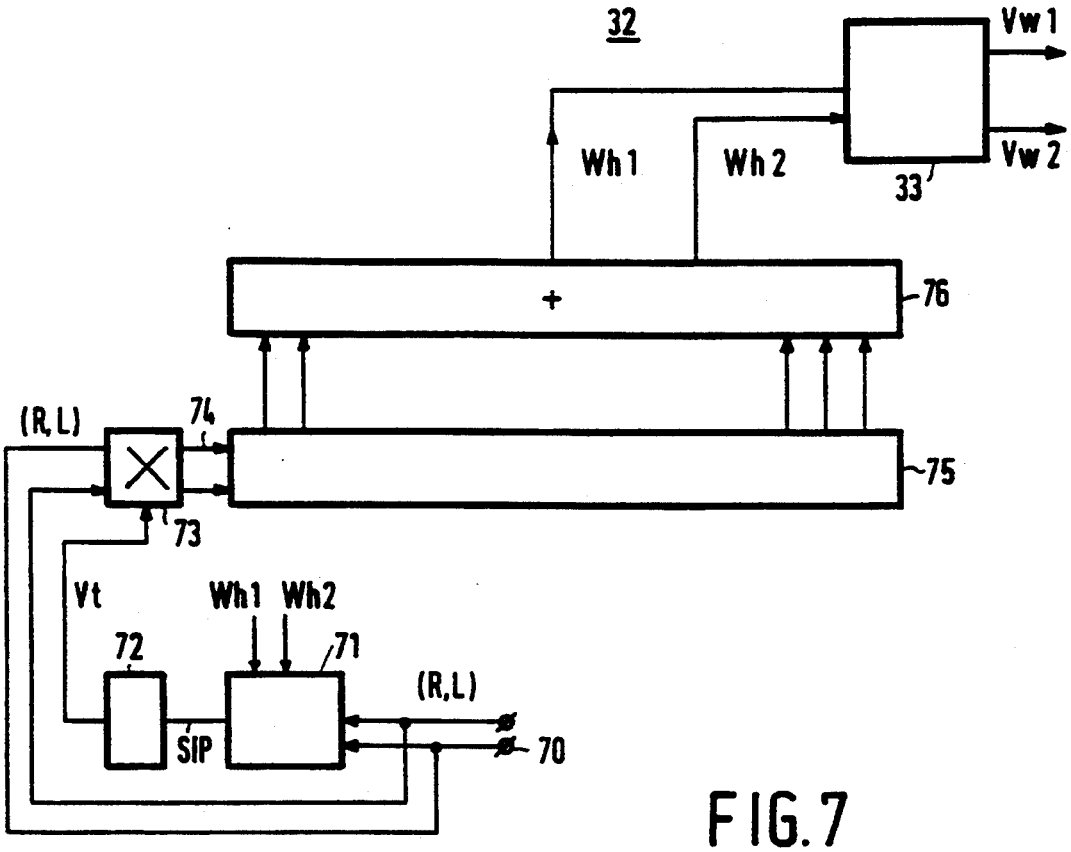
FIGS. 7 and 8 show embodiments of direction detection circuits to be used in the system according to the invention.

FIG. 7 shows an embodiment for a direction detection circuit 32. The direction detection circuit 32 has an input 70 for receiving the successive combinations (R,L) of the signal values of the left and right channel signals. The combinations on input 70 are applied to a circuit 71. The circuit 71 is further supplied with a first vector component signal Wh1 and a second vector component signal Wh2 which represent the components of the direction vector that are parallel with the axes 20 and 21 in the state area. The circuit 71 calculates therefrom in customary fashion a signal Sip which is equal to $R.Wh1+L.Wh2$. The signal Sip represents the inproduct of the direction vector and the vector determined by the combination (R,L). A sign detection circuit 72 detects the sign of the inproduct in response to the signal Sip. A signal Vt representing this sign is applied to a first input of a circuit 73 by the sign detection circuit 72. A second input of circuit 72 is connected to the input 70 for receiving the combinations (R,L).

The circuit 73 is arranged for deriving a first and a second adaptation value for the vector component signals from the combination of signal values and the sign of the inproduct, the ratio between the first adaptation value and the second adaptation value corresponding to the ratio between the signal values of the left and the right channel signals from the combination of signal values, and the signs of the first and second adaptation values being determined by the sign of the inproduct and the signs of the signal values of the left and right signal channels from the combination of signal values.

This may be realized, for example, with two multipliers multiplying the signal values of the left and right channel signals from the combination (R,L) by the output signal Vt of the circuit 72. Signals representing the first and second adaptation values may be tapped from the outputs of these multipliers. Signals representing the first and second adaptation values are applied to an input of a shift register 75. Each time a new combination of first and second adaptation values has been determined, these new adaptation values are shifted into the shift register 75. The storage capacity of the shift register is sufficient to determine the direction vector in a reliable way. The shift register 75 has parallel outputs for outputting signals that represent the stored first and second adaptation values. To supply the first and second adaptation values, the outputs of the shift register are connected to the inputs of a summing circuit 76. The summing circuit is one of a customary type which determines the sum of all first adaptation values applied to its inputs and determines the sum of all second adaptation values applied to its inputs. A signal indicative of a certain sum of first signal values is output as the first vector component signal Wh1. A signal indicative of the sum of second adaptation values is output as a second vector component signal Wh2.

The circuit 33 customarily derives therefrom the signals Vw1 and Vw2, which represent the weight factors w1 and w2. As already described hereinbefore, sin ($\theta$) and cos ($\theta$) are suitable values for the weight factors. The values of these cosine and sine functions may be customarily determined from the signals Wh1 and Wh2.

Figure 8:
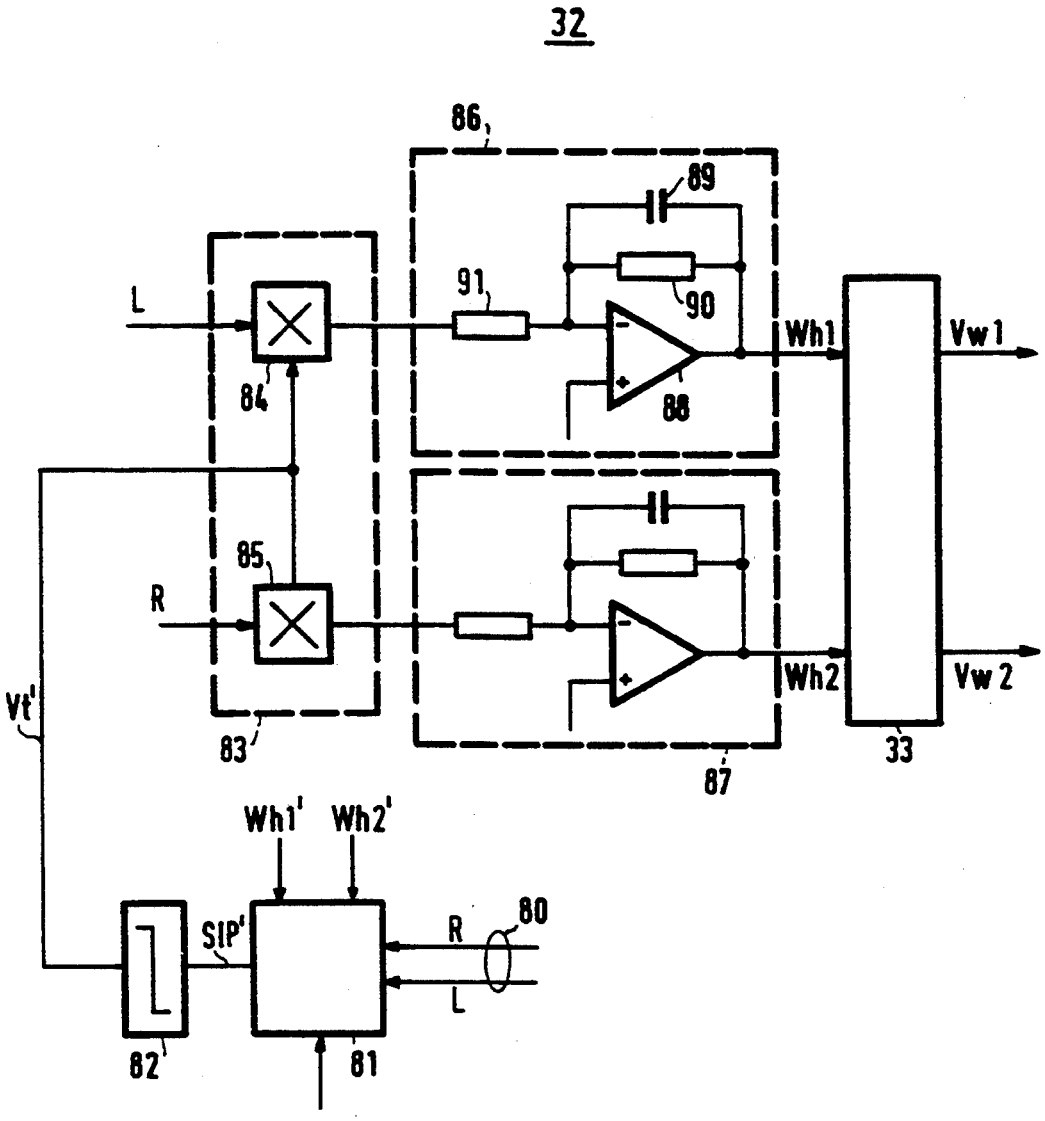

FIG. 8 shows another embodiment of the direction detection circuit 32.

The direction detection circuit has inputs 80 for receiving signal values of the left channel signal (L) and right channel signal (R). The signals R and L together form a combination signal V(R,L). The combination signal at the input 80 is applied to a circuit 81. The circuit 81 is further supplied with a first vector component signal Wh1' and a second vector component signal Wh2' which represent the components of the direction vector which are parallel with the axes 20 and 21 in the state area. The circuit 80 computes therefrom in customary fashion a signal Sip' which is equal to R.Wh1'+L.Wh2'. The signal Sip' represents the inproduct of the direction vector and the vector determined by the combination signal V(R,L). A sign detection circuit 82 detects the sign of the inproduct in response to the signal Sip'. A signal Vt' representing this sign is applied by the sign detection circuit 82 to a first input of a circuit 83. Further inputs of circuit 83 are supplied with the left channel signal (L) and the right channel signal (R) which form part of the combination signal V(R,L).

The circuit 83 computes in like manner to the circuit 73 the first and second adaptation values.

This may be realized, for example, with two multipliers 84 and 85 which multiply the signal values of the left and right channel signals from the combination signal V(R,L) by the output signal Vt' of circuit 82. Signals representing the first and second adaptation values may be tapped from the outputs of these multipliers. A signal representing the first adaptation value is applied to an integration circuit 86. A signal representing the second adaptation value is applied to an integration circuit 87. The integration circuits 86 and 87 are identical. They may comprise, for example, an operational amplifier 88 whose output is fed back to the inverting input across a capacitor 89. A resistor 90 is connected in parallel with the capacitor 89. The inverting input of the operational amplifier 88 of integration circuit 86 is coupled to the output of the multiplier 84 through a resistor 91. In like manner, the inverting input of the operational amplifier of integration circuit 87 is coupled to the output of the multiplier 87. The integration circuit 86 integrates the output signal of the multiplier 84. This signal represents the first adaptation values. At the output of the operational amplifier 88 of the integration circuit 86 there is thus a signal that represents the vector component signal Wh1. The capacitor 89 is bridged by a resistor 90. This means that the influence the multiplier output signal has on the size of the vector component signal Wh1 diminishes as the signal has occurred further in the past. This means that the signal Wh1 is especially determined by the first adaptation values determined most recently. Determining the vector component signal Wh2 by means of the integration circuit corresponds to deriving the signal Wh1 by the integration circuit 86. The circuit 33 derives from the signals Wh1 and Wh2 the signals Vw1 and Vw2.

Figure 9:
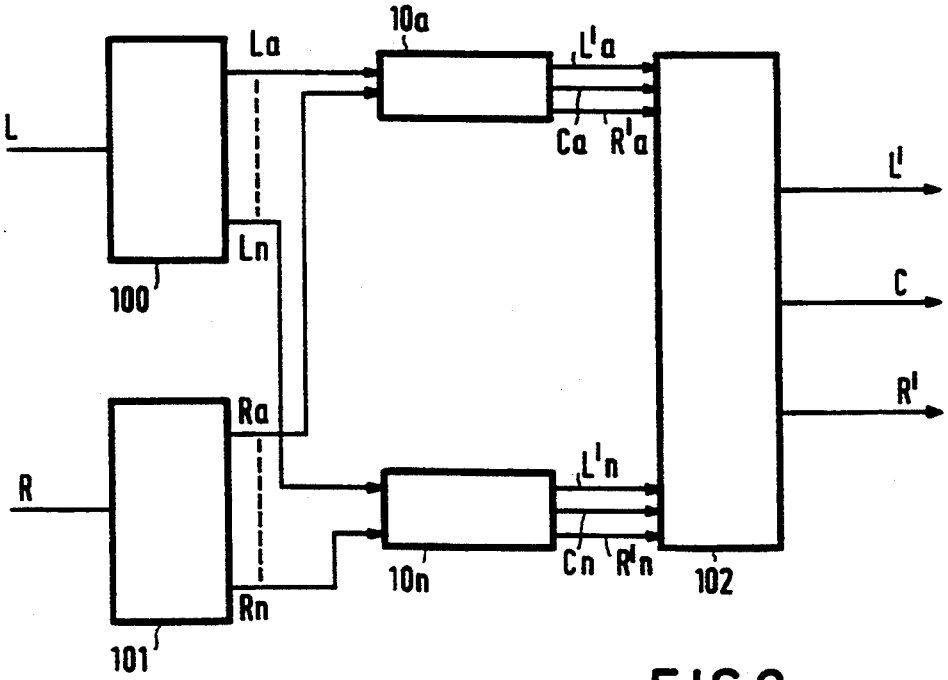

The virtual sound sources in the stereophonic image generally differ both in place and frequency. Therefore, it is advantageous to split up the correlated signal components for different frequency bands. In this manner, there is achieved that the correlated components for different sound sources are split up independently. An embodiment for the system in which this is realized is shown in FIG. 9. The system shown comprises a first filter bank 100 of a customary type which splits up the left channel signal into a plurality of sub-signals La, . . . , Ln, whose frequency spectra are situated in different frequency bands. In like manner, the right channel signal R is split up into a plurality of sub-signal Ra, . . . , Rn with the aid of a filter bank 101. A center sub-signal and adapted left and right sub-signals are derived per frequency band by means of systems 10*a*, . . . , 10*n* which are similar to the system 10 shown in FIG. 3. A combining circuit 102 forms the adapted left channel signal L', the adapted right channel signal R' and the center channel signal from the sub-signals.

I claim:

1. A system for deriving a center channel signal from a stereophonic signal comprising a left channel signal and a right channel signal, characterized in that said system comprises:

input means for inputting said left channel signal and said right channel signal;

deriving means, coupled to said input means, for deriving a measure for a direction of a direction vector which, in a state area in which combinations of signal values of the left and right channel signals are shown at specific instants, is indicative of the direction determined in the state area by the signal values originating from the most powerful sound source;

weighting factor determining means, coupled to said deriving means, for determining first and second weighting factors in response to the measure derived by said deriving means;

weighting means, coupled to said input means and said weighting factor determining means, for weighting the left and right channel signals with said first and second weighting factors, respectively, thereby forming a weighted left channel signal and a weighted right channel signal; and combining means, coupled to said weighting means, for combining said weighted left channel signals and said weighted right channel signal thereby forming said center channel signal.

2. System as claimed in claim 1, characterized in that the deriving means comprises:

means for producing a first vector component signal and a second vector component signal which represent components of said direction vector;

deriving means for deriving a first adaptation value and a second adaptation value for the first and second vector component signals from the combination of signal values and the inproduct of the direction vector and the vector determined by the combination of signal values, the ratio between the first and second adaptation values corresponding to the ratio between the signal values of the left and right channel signals of the signal value combination, and the signs of the first and second adaptation values being determined by the sign of the inproduct and the signs of the signal values of the left and right channel signals from the signal value combination; and adaptation means for adapting the signal values of vector component signals by adding the first adaptation value to the first vector component signal and by adding the second adaptation value to the second vector component signal.

3. System as claimed in claim 1, characterized in that the weighting factor determining means determines the signs of the weight factors in dependence on the direction of the direction vector.

4. System as claimed in claim 3, characterized in that one of the weight factors is proportional to the cosine of an angle that determines the direction of the direction vector, the other weight factor being proportional to the sine of this angle, whereas the sum of the squares of the weight factors is essentially constant.

5. System as claimed in claim 1, characterized in that the system comprises:

a first filter bank for splitting up the left channel signal into a plurality of left sub-signals having frequency spectra situated in different frequency bands; and a second filter bank for splitting up the right channel signal into a plurality of right sub-signals having frequency spectra corresponding to the frequency bands into which the left channel signal has been split up, the system deriving, per frequency band, a center sub-signal, and for combining these center sub-signals to form the center channel signal.

6. System as claimed in claim 2, characterized in that the weighting factor determining means determines the signs of the weight factors in dependence on the direction of the direction vector.

7. System as claimed in claim 6, characterized in that one of the weight factors is proportional to the cosine of an angle that determines the direction of the direction vector, the other weight factor being proportional to the sine of this angle, whereas the sum of the squares of the weight factors is essentially constant.

8. System as claimed in claim 2, characterized in that the system comprises:

a first filter bank for splitting up the left channel signal into a plurality of left sub-signals having frequency spectra situated in different frequency bands; and a second filter bank for splitting up the right channel signal into a plurality of right sub-signals having frequency spectra corresponding to the frequency bands into which the left channel signal has been split up, the system deriving, per frequency band, a center sub-signal, and for combining these center sub-signals to form the center channel signal.

9. System as claimed in claim 3, characterized in that the system comprises:

a first filter bank for splitting up the left channel signal into a plurality of left sub-signals having frequency spectra situated in different frequency bands; and a second filter bank for splitting up the right channel signal into a plurality of right sub-signals having frequency spectra corresponding to the frequency bands into which the left channel signal has been split up, the system deriving, per frequency band, a center sub-signal, and for combining these center sub-signals to form the center channel signal.

10. System as claimed in claim 4, characterized in that the system comprises:

a first filter bank for splitting up the left channel signal into a plurality of left sub-signals having frequency spectra situated in different frequency bands; and a second filter bank for splitting up the right channel signal into a plurality of right sub-signals having frequency spectra corresponding to the frequency bands into which the left channel signal has been split up, the system deriving, per frequency band, a center sub-signal, and for combining these center sub-signals to form the center channel signal.

11. System as claimed in claim 6, characterized in that the system comprises:

a first filter bank for splitting up the left channel signal into a plurality of left sub-signals having frequency spectra situated in different frequency bands; and a second filter bank for splitting up the right channel signal into a plurality of right sub-signals having frequency spectra corresponding to the frequency bands into which the left channel signal has been split up, the system deriving, per frequency band, a center sub-signal, and for combining these center sub-signals to form the center channel signal.

12. System as claimed in claim 7, characterized in that the system comprises:

a first filter bank for splitting up the left channel signal into a plurality of left sub-signals having frequency spectra situated in different frequency bands; and a second filter bank for splitting up the right channel signal into a plurality of right sub-signals having frequency spectra corresponding to the frequency bands into which the left channel signal has been split up, the system deriving, per frequency band, a center sub-signal, and for combining these center sub-signals to form the center channel signal.

* * * * *